US005597190A

United States Patent [19]

DeMars

[11] Patent Number: 5,597,190

[45] Date of Patent: Jan. 28, 1997

[54] CAN HOLDER

[76] Inventor: Robert A. DeMars, 23221 Ladrillo St., Woodland Hills, Calif. 91367

[21] Appl. No.: 231,793

[22] Filed: Apr. 25, 1994

Related U.S. Application Data

[63] Continuation-in-part of Ser. No. 35,293, Mar. 22, 1993, abandoned.

[51] Int. Cl.[6] ..... B65D 25/28

[52] U.S. Cl. ..... 294/33; 220/742; 294/27.1; D7/623

[58] Field of Search ..... 294/27.1, 29, 31.2, 294/32, 33; 16/114 R, 114 A; 215/395, 396; 220/737, 738, 741, 742, 752, 755, 756, 758, 759, 769, 771; 248/145.6, 311.2, 312.1; D7/517, 622, 623; D9/434, 443, 455

[56] References Cited

U.S. PATENT DOCUMENTS

| | | | |
|---|---|---|---|
| D. 174,432 | 4/1955 | Johnson | D7/622 |
| D. 215,748 | 10/1969 | Wallace | 294/33 X |
| D. 232,614 | 9/1974 | Brown | 294/33 X |
| D. 233,118 | 10/1974 | Finn | 294/33 X |
| 1,280,675 | 10/1918 | Cullen | 294/33 X |
| 2,128,466 | 8/1938 | Machotka | 294/33 |
| 2,424,094 | 7/1947 | Herr | 294/33 |
| 2,639,502 | 5/1953 | Wormelle | 294/33 X |
| 2,665,936 | 1/1954 | Moore | 294/33 |
| 2,689,760 | 9/1954 | Vanous | 294/29 |
| 2,707,827 | 5/1955 | Petram | 294/33 X |
| 2,806,732 | 9/1957 | Montanaro | 294/33 |
| 2,902,310 | 9/1959 | Berce | 294/33 |
| 2,905,500 | 9/1959 | Thombs | 294/29 X |
| 3,029,975 | 4/1962 | Aiello | 294/29 X |
| 3,443,829 | 5/1969 | Lohmeyer | 294/32 |
| 4,299,366 | 11/1981 | Kurzius | 294/33 X |
| 4,602,723 | 7/1986 | DeMars | 294/27.1 X |
| 4,654,274 | 3/1987 | DeMars | 294/33 X |
| 4,791,030 | 12/1988 | DeMars | 294/27.1 X |
| 4,898,297 | 2/1990 | Wheeler | 294/33 X |

FOREIGN PATENT DOCUMENTS

| | | | |
|---|---|---|---|
| 7402056 | 8/1975 | Netherlands | 294/33 |
| 919799 | 2/1963 | United Kingdom | 294/32 |

*Primary Examiner*—Johnny D. Cherry

[57] ABSTRACT

A beverage can holder having a figurine handle and comprising a first attachment portion for attachment to the upper rim of a beverage can and a second attachment portion for attachment to the bottom surface or rim of the beverage can. An outwardly projecting stabilizing member is connected to the second attachment portion to provide stability to the can and attached handle.

1 Claim, 5 Drawing Sheets

Fig. 4.
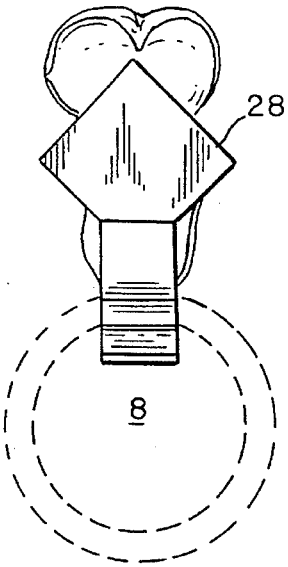
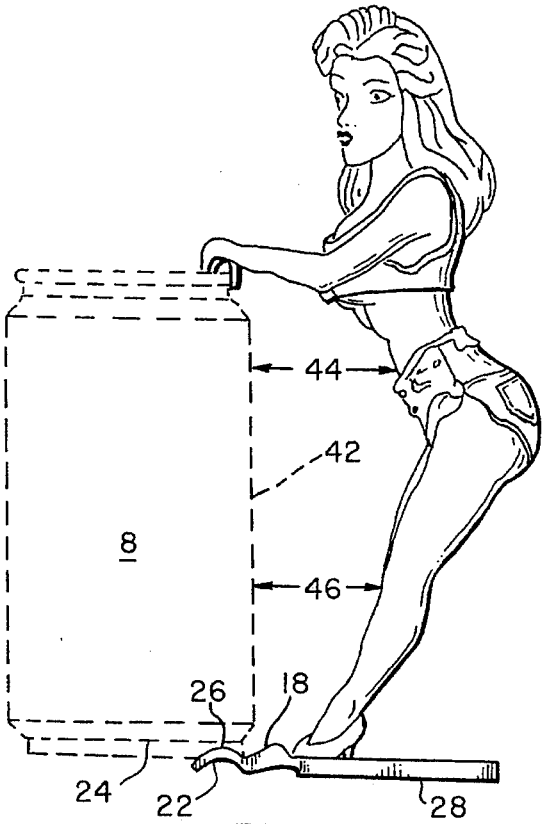
Fig. 6.
Fig. 5.
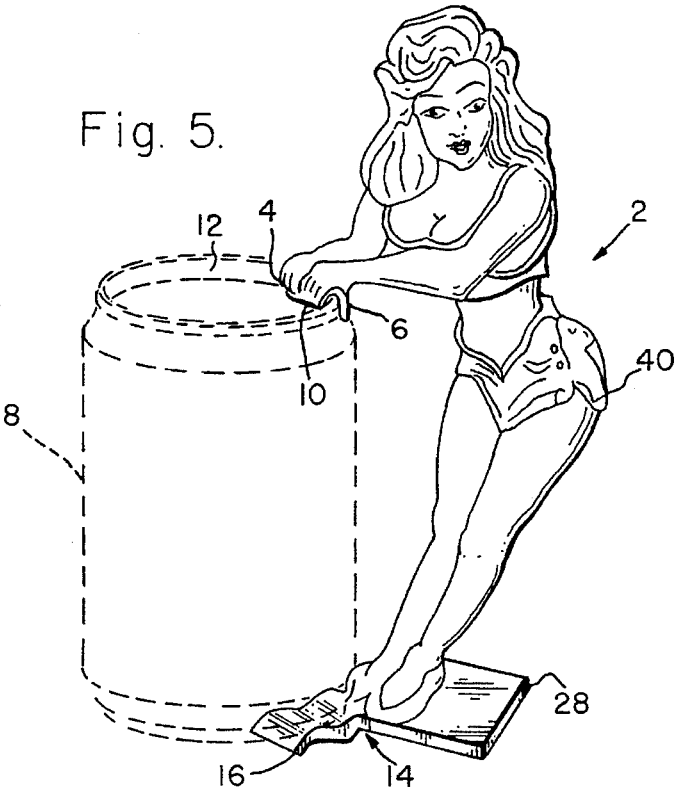

CAN HOLDER

This is a Continuation-In-Part Application of application Ser. No. 08/035,293 with a filing date of Mar. 22, 1993 now abandoned.

FIELD OF THE INVENTION

This invention pertains to a beverage can holder, which differs considerably from beverage can holders of the prior art and is an attractive novelty, wherein the beverage can holder makes a beverage can into a mug or the like. That is, the novelty beverage can holder of the instant application may be configured into a variety of figures and is easily attached to the top and bottom of beverage cans to form a handle therefor.

BACKGROUND OF THE INVENTION

Beverage cans for beer, soda and other beverages are ubiquitous in nature and, when the beverage is cold, it is desired to be able to grasp the beverage can for drinking purposes without warming up the contents of the can as by grasping with the human hand. Sometimes, depending upon the temperature of the can, to hold the can in the hand of the drinker is uncomfortable because of the extreme cold of the beverage contained within the can.

There have been a variety of can holders suggested in the prior art for insulating the can from the hand of the drinker and further providing a means whereby the beverage can can be made into a mug-type drinking container to allow the drinker to grasp a handle and hold it as one would hold a mug.

Providing a novelty, reusable handle for converting beverage cans into mugs and having a variety of figures associated therewith, with the figure actually forming a graspable handle, which is easily attached and detached for beverage cans while still insulating the contents thereof from the hand of the user, has been a desiratum of novelty device manufacturers for some time.

However, when forming a handle with a figure and sometimes without a figure, attachable and detachable handle means have suffered in that when only attached to the full beverage can, the same provides a stable device. However, once the contents of the can are drunk down or totally eliminated, the attached handle on the can becomes very unstable because of the counter-balancing fluid, within the beverage can, being absent.

The herein disclosed invention allows for a novelty can holder which is easily attached to and detached from the beverage can and which provides a stable combination regardless of the fluid content in the can.

As exemplary of some of the prior art devices, the following patents are exemplary of the prior art handles for attachment to beverage cans and the like, and of their drawbacks which the beverage can of the instant application and invention overcomes.

U.S. Pat. No. 1,280,675

This patent is directed to a can utensil which has a handle portion c and having a lower portion adapted to engage the underside of a can and having an upper yoke with a hinged member for impaling attachment to the upper lid of the can by reason of spurs e and f.

U.S. Pat. No. 2,639,502

This patent is directed to a handle 24 having a combined can opener which is utilized for opening the beverage can and wherein the handle is engaged upon the upper and lower rims of the beverage can in detachable relationship thereto.

U.S. Pat. No. 2,665,936

This patent is directed to a beer can handle having an upper portion attachment to the outside rim of the can with a curved handle portion 15 and an extending bottom portion 17 that extends to the opposed rim portion for attachment relative to the upper portion of the can handle.

U.S. Pat. No. 2,902,310

This patent pertains to a combined can puncturing and holding device which has an inverted can opening portion which also is part of a stabilizing mechanism to abut the side of the can and wherein a handle portion 18 is secured by means of a prong member 27 to the upper lid of the can.

U.S. Pat. No. 2,707,827

This patent pertains to a combined can holder and opener wherein the handle member is configured for disposition and attachment in releasable fashion to the upper and lower rims of a can with which it is associated.

U.S. Pat. No. 2,806,732

This patent is directed to a removable can holder wherein the upper part of the handle has a forked configuration for attachment to the rim of the can and wherein the bottom portion of the handle is of U-shaped configuration to engage the lower rim or edge of the can.

U.S. Pat. No. Des. 233,118

This design patent is directed to a detachable handle for a beverage can or the like wherein an upper rim engaging portion and a lower engaging member are connected via an intermediate can holding portion.

SUMMARY AND OBJECTS OF THE INVENTION

It is an object of the invention to provide a novelty can holder for releasable attachment to beverage cans.

It is another object of the invention to provide a uniquely configured can handle which utilizes a handle portion configured in the shape of a figure.

It is another important object of the invention to provide a can handle which is easily attachable and detachable to a beverage can and which has a full range of stability regardless of the fluid content of the can.

It is still another important object of the invention to provide a novelty can handle wherein the figure associated with the elements of the can-grasping portions of the handle is configured in the configuration of a human figure.

It is still another important object of the invention to provide a novelty can handle which is graspable by the human hand and which insulates the contents of the beverage can from the hand of the drinker and further, wherein the novelty handle, when associated with the can, is stable.

It is still another important object of the invention to provide a can handle for association with a beverage can wherein the beverage can handle is counterbalanced to offset any instability of the associated can and handle once the contents of the beverage can are emptied.

Generally, the invention pertains to a novelty beverage can holder or the like comprising the combination of first attachment means for attachment to the upper rim of a beverage can or the like and a second attachment means for attachment to the bottom surface of said beverage can or the like, and wherein an intermediate portion is operatively connected to said first and second attachment means and forms a handle or the like capable of being grasped by the human hand and includes stabilizing means operatively connected to the second attachment means for stabilizing said beverage can handle or the like once said beverage can or the like is empty, whereby the beverage can holder or the like is maintained in an upright position when said holder is attached to said beverage holder or the like.

These and other objects of the invention will become apparent from the hereinafter following commentary taken in conjunction with the drawings.

BRIEF DESCRIPTION OF THE DRAWINGS

FIG. 4 is a view taken along the line 4—4 of FIG. 3 with the beverage can shown in dotted line;

FIG. 5 is a view similar to FIG. 1 but showing the beverage can in dotted line and more clearly showing the first and second attachment means of a can handle for association with the beverage can;

FIG. 6 is a view similar to FIG. 3 but showing the can in dotted line, better illustrating the bottom attachment means of a can handle of the invention;

DETAILED DESCRIPTION OF A PREFERRED EMBODIMENT

Figure 2:
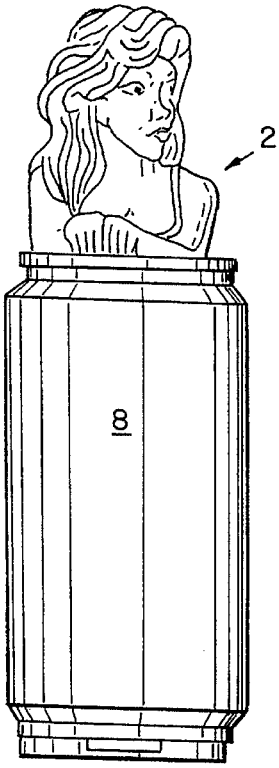
FIG. 2 shows a front view of a novelty can handle of the invention taken along the line 2—2, FIG. 1.

Referring to the figures of drawings wherein like numerals of reference designate like elements throughout, it will be seen that the beverage can holder 2 in this particular instance having a first or upper attachment means 4, a U-shaped in cross-section configuration, is provided with a first lip 6 of sufficient depth to engage the exterior upper rim portion of beverage can 8 and wherein there is opposed lip portion 10 of slightly less depth than opposed lip 6 for engaging the inside surface 12 of beverage can 8.

The second or lower attachment means 14 is made up of an extending tab-like portion 16 having a first indentation or groove 18 adapted to accommodate the lower edge or rim 20 of beverage can 8 and having an extending portion 22 upraised to engage the bottom 24 of the can 8 by reason of upwardly extending surface 26 of tab portion 16.

Extending from second attachment means 14 is a stabilizing means 28 here taking the configuration of a polygonal figure or square integrally connected to extending tab portion 16.

The stabilizing member 28 acts as a counterbalance for the attached can holder 2 when associated with the beverage can 8 as will be seen.

Attached to the first or upper attachment means 4 and second or lower attachment means 14 is intermediate portion 40, here taking the configuration of a female figure. While a female figure is shown for the intermediate portion 40, it is understood that any type of figure may be utilized for the intermediate portion including cartoon figures, animals, or any such configuration, it only being important that the intermediate portion 40 is configured to allow an area of the intermediate portion 40 to be grasped by the human hand. To that end, it will be noted that intermediate portion 40 is somewhat outwardly curved or positioned relative to the longitudinal axis of can 8 so that the encircled fingers, around intermediate portion 40, will have room to grasp intermediate portion 40 relative to the exterior surface 42 of can 8.

That is, referring to the figures of drawing, the distance indicated by the arrows 44 and 46 should be sufficient to allow placement of encircling fingers of the holder's hand around beverage can holder 2 when associated with the can 8, as those of ordinary skill in the art will readily recognize.

The holder 2 in this disclosed embodiment is molded of moldable material and is integrally molded of plastic, for example. Those of ordinary skill in the art will recognize that various methods of forming the essential elements of the handle 2 will readily make themselves apparent. Additionally, those of ordinary skill in the art will recognize that the stabilizing means or counterbalancing element 28 may be of various shapes in order to gain stability of the associated handle 2 with beverage can 8. Those of ordinary skill in the art will also recognize that various configurations for intermediate portion 40 may be utilized, only keeping in mind the overall stability of the associated can handle 2 with the beverage can 8.

Thus in some instances, depending upon the configuration of intermediate portion 40, it may be necessary to have a larger or differently configured stabilizing means or counterbalance 28 to ensure that the handle 2 not only stands on its own when disassociated from the beverage can or the like, but is capable of stable placement, when associated with the beverage can 8, when the beverage can is empty.

Figure 7:
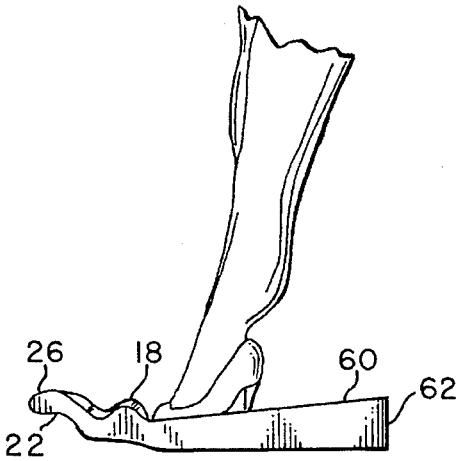
FIG. 7 is a partial view of a portion of the can holder shown in FIG. 3, illustrating a different embodiment.

Referring to FIG. 7, it will be noted that in this particular instance, stabilizing means 60 is, for all intents and purposes, the same with respect to the can attachment portions 18, 26 and 22, but differs from stabilizing means 28 shown in, for example, FIG. 6 in that the furthest extending portion 62 (from beverage can 8—not shown) is shimmed so as to give better balance to, for example, the can holder 2 when associated with the can 8. By shimmed it is meant that the thickness of stabilizing means 60 increases in thickness as it extends away from can 8, not shown. By comparing the thickness of the stabilizing means 60 with that of stabilizing means 28, as shown in FIG. 6, it will be seen that the stabilizing means 60 is of such a thickness and of such a configuration so as to give a shim effect for increased stability, as already described. This increased stability is found even more prominently when the can holder 2 is disassociated from the beverage can 8.

Figure 3:
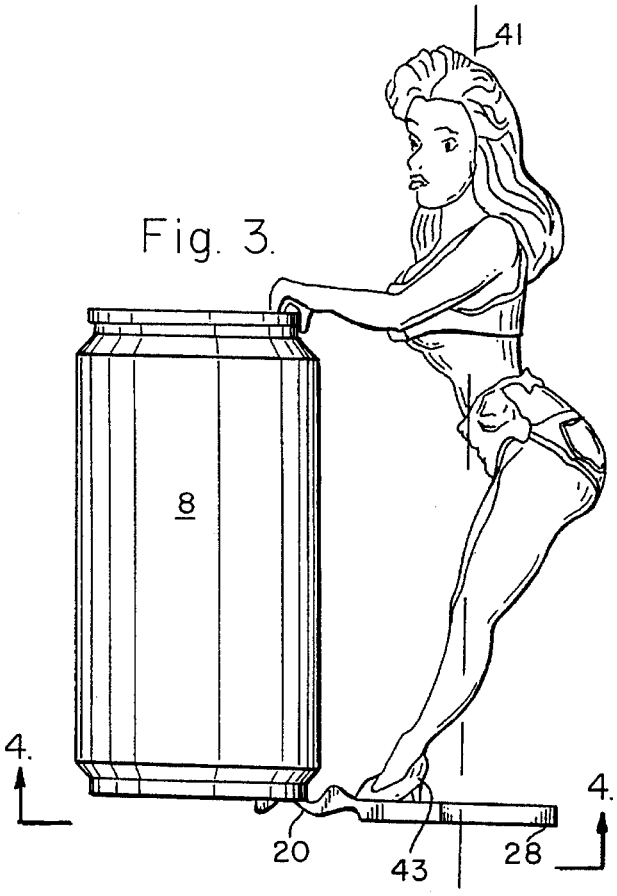
FIG. 3 is a view taken along the line 3—3 of FIG. 1 showing additional detail of a can handle of the invention.
Figure 1:
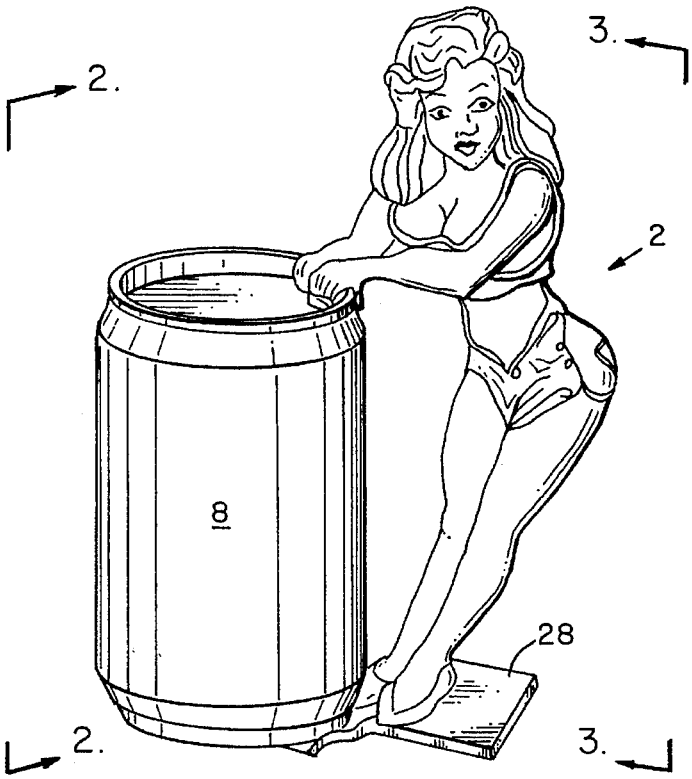
FIG. 1 is a perspective view of one of the novelty can handles of the invention associated with a beverage can.

With respect to the embodiment of the invention disclosed hereinbefore, it will be noted, for example, in referring to FIG. 3, that the stabilizing means 28 extends beyond what may be considered an equipoise axis or imaginary line 41 roughly equating to a line drawn through the center of gravity or mass of can holder 2, independent of its association with beverage can 8. It will be noted that the foot portion 43 of the figure making up intermediate portion 40 is substantially inward from the outwardly extending stabilizing member 28.

Figure 10:
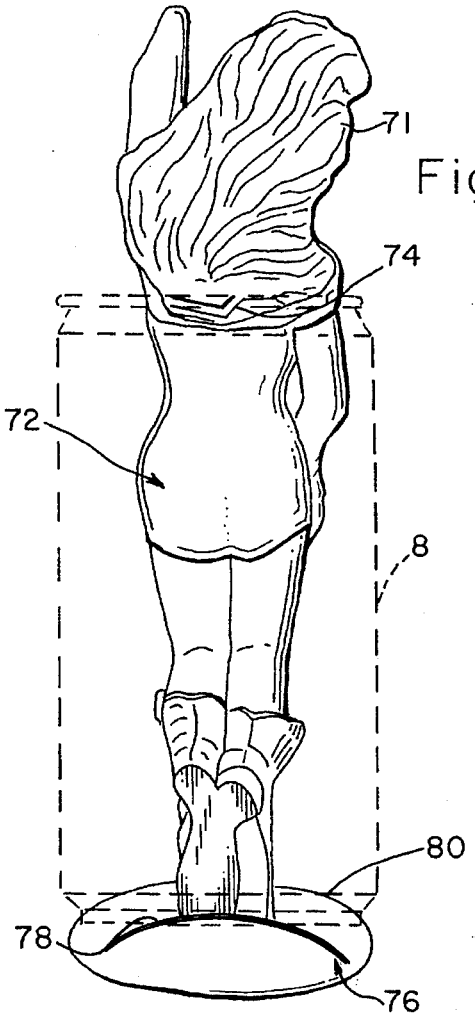
FIG. 10 is a back view of the FIG. 8 embodiment showing more details of construction.
Figure 8:
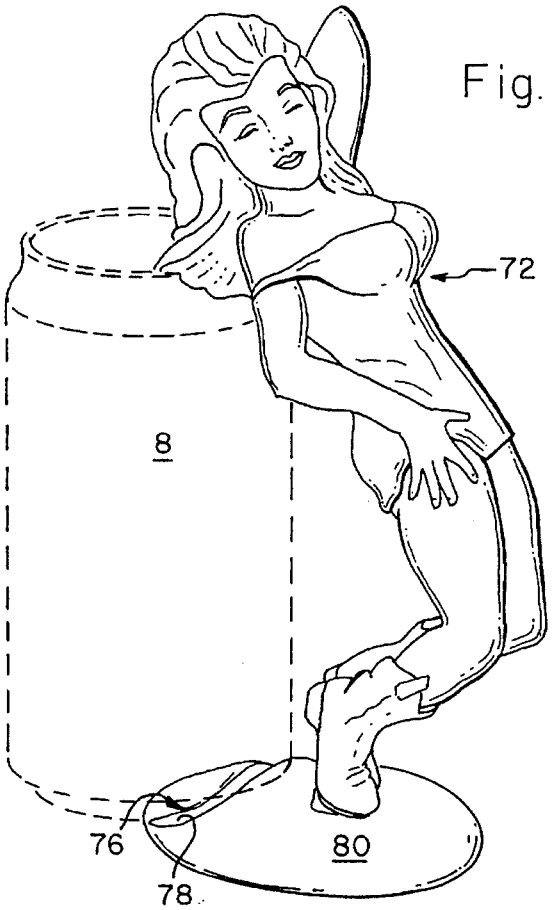
FIG. 8 is a perspective view of still another embodiment of the invention.
Figure 9:
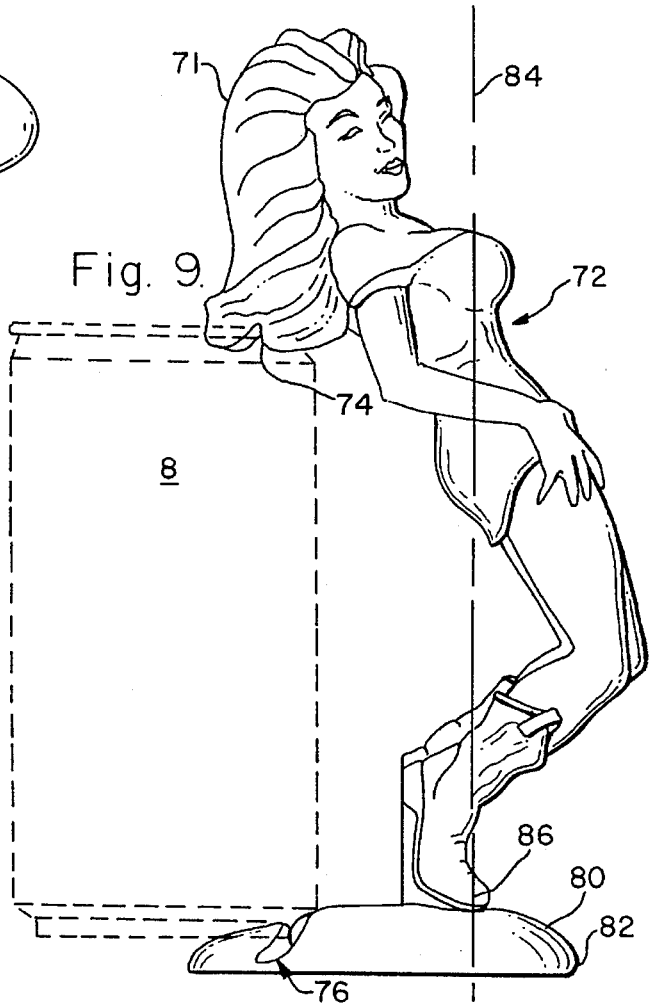
FIG. 9 is a side view of the FIG. 8 embodiment.

Referring now to FIGS. 8, 9 and 10, an alternative embodiment is illustrated. It will be noted that in this embodiment, the beverage can holder 72 is in the configuration of a woman leaning over wherein her flowing tresses 71 terminate in upper beverage can holder slot 74 and wherein the lower attachment means 76 is in the form of an arc-like groove 78 of sufficient depth to receive the lower bottom portion of beverage can 8 as shown in the figures of drawing. It will be noted that extending from the lower beverage can holding portion 76 is the stabilizing means 80, here again extending outwardly to the terminus 82 which is well beyond the equipoise reference line 84, to ensure stability of the can holder 72 when it is standing by itself or associated with the beverage can 8.

The intermediate portion of beverage can holder 72 is configured like that described for beverage can holder 2 with respect to the ability to allow the human hand to grasp the intermediate portion of can holder 72 as previously described for can holder 2. It will be noted that here also the extending stabilizing portion 80, or more specifically terminal 82, extends beyond what may be considered the foot part 86 of can holder 72.

Figure 13:
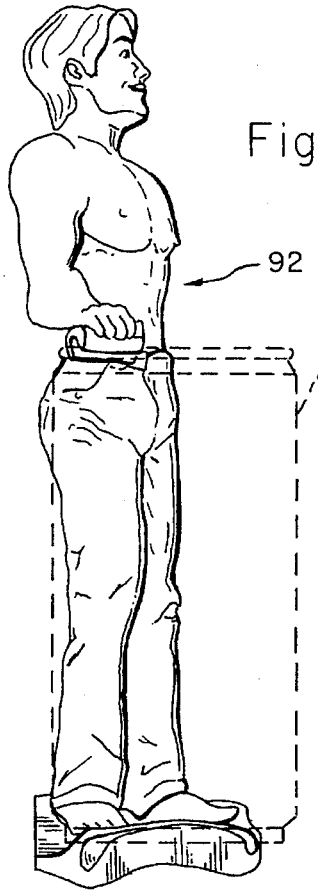
FIG. 13 is another view showing more details of construction of the beverage can holder depicted in FIG. 11.
Figure 11:
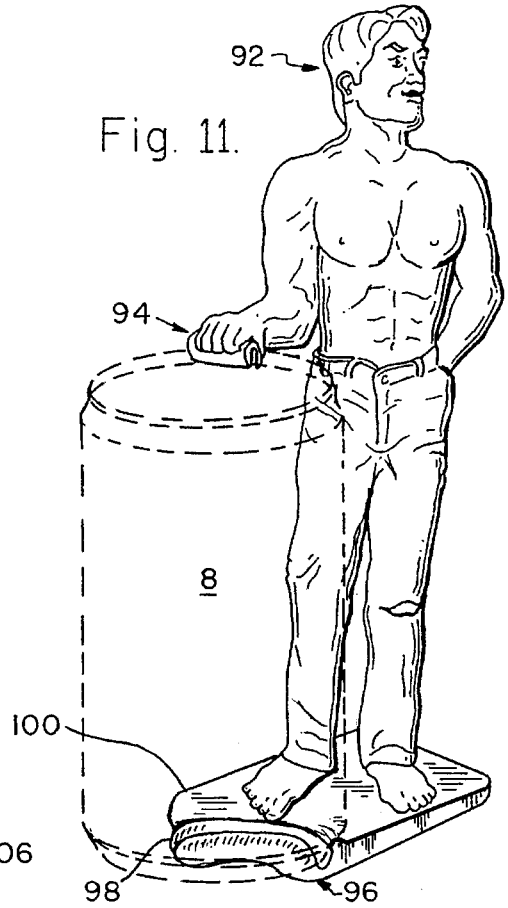
FIG. 11 is a perspective view of still another alternate embodiment of the invention.
Figure 12:
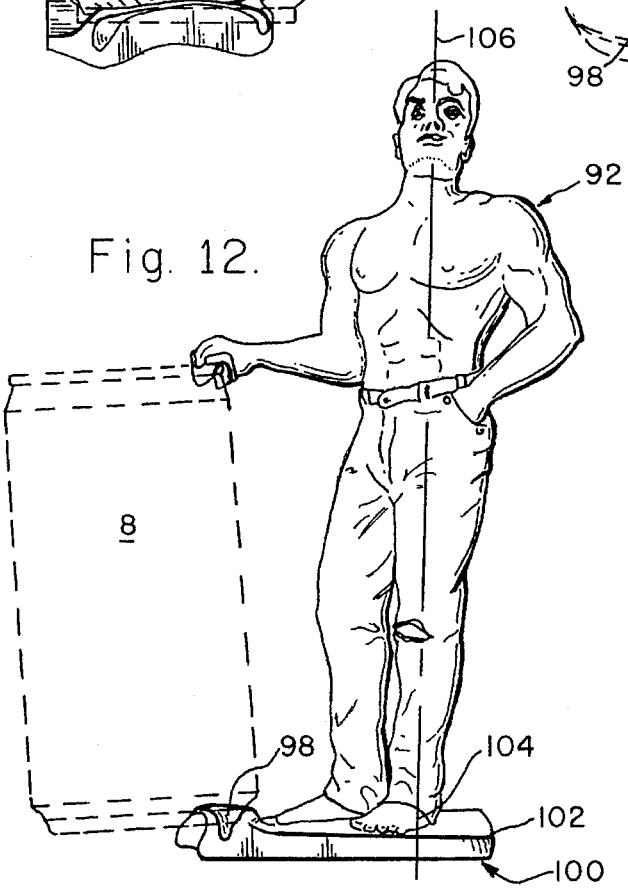
FIG. 12 is a side view of the FIG. 11 alternate embodiment.

Referring now to still another embodiment of the invention as illustrated in FIGS. 11, 12 and 13, in this particular instance, the beverage can holder 92 takes the form of a male figure having an upper beverage can holder portion 94 formed as a beverage can retainer similarly described for the FIGS. 1–7 embodiment and having a lower beverage rim or bottom can holder 96, in this particular instance taking the form of a semi-circularly shaped slot or groove 98 shaped and of such depth as to receive the bottom rim portion of a beverage can 8, as shown. It will be noted that the extending stabilizing member 100 has a terminal or extending portion 102 extending beyond the feet portion 104 of can holder 92, and more specifically, the reference line or equipoise axis 106, as best seen in FIG. 12.

Thus, there have been disclosed four different embodiments having three different main figure configurations, for a can holder which is unique and novel. While the specific figures have been shown to accommodate beverage cans of certain sizes, it will be appreciated that if larger cans or different configured cans are to be accommodated, those of ordinary skill in the art will recognize changes and modifications that would be necessary to the practice of the hereindisclosed invention. While it is contemplated that can holders of the instant invention be molded integrally of plastic, this is by no means restrictive on the materials of construction or the components making up same.

The beverage can holder of the disclosed invention may have various modifications and changes, all of which will not distract from the essence of the invention and all of which are intended to be covered by the appended claims.

I claim:

1. A novelty beverage can holder comprising the combination of: a first attachment means for attachment to a small portion of the upper rim of a beverage can, a second attachment means for attachment to a small portion of the bottom surface of a beverage can and an intermediate portion operatively connected to said first and second attachment means and forming a handle capable of being grasped by the human hand, said intermediate portion forming said handle having an equipoise axis formed by a line through the center of gravity of said intermediate portion forming said handle independent of said can holder's association with a beverage can, and stabilizing means adapted to contact a surface upon which said beverage can holder is set, and being outwardly projecting at least beyond said equipoise axis, and being operatively connected to said second attachment means for stabilizing said beverage can holder, whereby said beverage can holder is maintained in an upright position when said holder is attached to said beverage can and placed upon said surface, and wherein said holder is configured as a human being having feet and the feet thereof lie inward towards the can and said stabilizing means extends laterally beyond the feet.

* * * * *